US006644768B2

(12) United States Patent
Vega et al.

(10) Patent No.: US 6,644,768 B2
(45) Date of Patent: Nov. 11, 2003

(54) THREE- AND TWO-DIMENSIONAL IMAGES FORMED BY SUSPENDED OR TRANSITORY COLORANT IN A VOLUME

(75) Inventors: Ramon Vega, Barcelona (ES); Antoni Murcia, San Diego, CA (US); Ramon Borrell, Barcelona (ES); Xavier Girones, Tarragona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/729,549

(22) Filed: Dec. 4, 2000

(65) Prior Publication Data

US 2002/0067382 A1 Jun. 6, 2002

(51) Int. Cl.[7] ..... G09F 19/00

(52) U.S. Cl. ..... 347/12; 347/2; 347/6; 347/9; 347/12; 40/406; 239/693; 239/695

(58) Field of Search ..... 239/690.1, 693, 239/695, 20; 347/53, 52, 82, 73, 2, 589, 36, 6, 9, 12; 283/86, 91; 40/406, 407

(56) References Cited

U.S. PATENT DOCUMENTS 3,560,641 A * 2/1971 Taylor et al. ..... 347/40
4,265,402 A * 5/1981 Tsai ..... 40/406
4,294,406 A * 10/1981 Pevnick ..... 239/20
4,596,990 A * 6/1986 Hou ..... 347/73
5,508,722 A * 4/1996 Saito ..... 347/17
5,737,860 A * 4/1998 Whigham et al. ..... 40/406

* cited by examiner

*Primary Examiner*—Judy Nguyen
*Assistant Examiner*—Julian D. Huffman
(74) *Attorney, Agent, or Firm*—Peter I. Lippman

(57) ABSTRACT

An arbitrary 3D or 2D shape is formed by construction from colorant in a volume—which may be cylindrical, annular, or of arbitrary cross-section, depending on form of the invention. In some forms, a 2D-extended array of colorant-ejecting nozzles is disposed in a particular linear direction relative to the volume, and a programmed processor controls ejection of colorant from the nozzles to pass through the volume. A 2D colorant-retrieving frame (ideally back-to-back with the array) is disposed in a second linear direction opposite to the one particular direction, from the array, to recover the colorant and thus erase the image—which can then be refreshed, with animation changes if desired, by the writing array. Colorant is moved through the volume by gravity, or by continuous ejection of material from the array and suction at the frame to form a suspending fluid flow—the array moving at equal but opposite velocity so that the image is stationary. The frame is a passive sump for colorant recovery, or has a pump for returning colorant to the array for reuse—in which case the array best ejects colorant of plural properties and the device has filters to separate retrieved colorant by those properties. In some forms, colorant is stroboscopically lighted to display apparent motion of an image element. A force field can be used to control, or help control, colorant position after ejection.

24 Claims, 5 Drawing Sheets

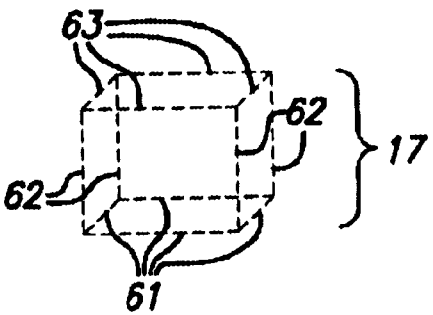
FIG. 11
FIG. 12
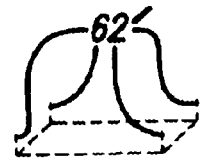
FIG. 13
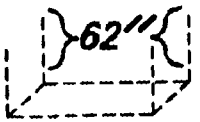
FIG. 14
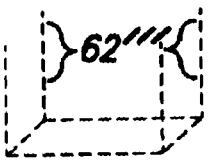
FIG. 15
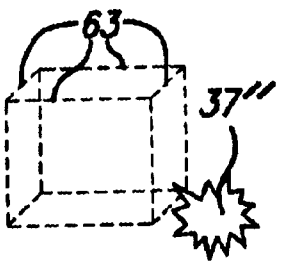
FIG. 16

THREE- AND TWO-DIMENSIONAL IMAGES FORMED BY SUSPENDED OR TRANSITORY COLORANT IN A VOLUME

FIELD OF THE INVENTION

This invention relates generally to machines and procedures for forming a three-dimensional or two-dimensional image as actual physical shapes of colorant in an image space. The image is not merely an optical projection, and also not colorant deposited on a hardcopy medium, but rather is formed as colorant passing through or suspended in an atmospheric environment or void.

BACKGROUND OF THE INVENTION

Many systems and procedures for forming an image are known. These include images formed on surfaces as by engraving or sculpturing—whether in stone, plaster, metal, wood, plastic or other media—or by depositing colorant on surfaces, as for example in penciling or painting, or in printing by photographic, letterpress, offset, or incremental (e.g. inkjet or laser) techniques.

Modernly such systems and procedures also include optical projections that are two-dimensional—such as slide transparencies and overhead projections, cinematographic moving pictures, and video displays. Other such optical-projection systems and procedures are three-dimensional—particularly holograms, and laser light shows—or seemingly so, as in the case of 3D movies that rely on special eyeglasses to direct different components of a scene to an observer's eyes.

Such three-dimensional optical effects generally either require complementary devices (such as the 3D glasses) or require viewing from a narrow range of angles about the optimal viewpoint. In any event, none of these systems and procedures is meaningfully pertinent to the technology introduced in this document.

Other image-forming technologies, more relevant to the present invention, either pass colorant through or suspend colorant in some sort of atmosphere. Such technologies may be said to form an image that is "mechanical"—i.e. that exists in physical substance, in the manner of the above-mentioned images on surfaces.

These technologies include airplane skywriting, and water fountains controlled in various ways to generate patterns in the moving water. Skywriting is generally limited to rather coarsely formed images that are subject to disruption by winds in the sky.

Some elaborate water fountains and falling-water displays make pleasing images which are, however, characteristically only abstract patterns—that is, patterns available through a limited range of variation in control of the water-ejecting nozzles. Such liquid-element displays generally lack means for selectively erasing or refreshing portions of the patterns, as well as means for fine control and timing of the liquid ejection; and accordingly are unable to form arbitrary shapes such as people or other creatures, or objects or landscapes, etc.

These fountains or falling-water displays therefore lack the capacity to create and modify image features on a generally continuous basis. They also thus lack the ability to create moving three-dimensional images of arbitrary shapes.

Thus important elements of the technology used in the field of the invention—although esthetically pleasing, entertaining and otherwise certainly worthwhile—are relatively primitive and susceptible to useful refinement.

SUMMARY OF THE DISCLOSURE

The present invention introduces such refinement. In its preferred embodiments, the present invention has several aspects or facets that can be used independently, although they are preferably employed together to optimize their benefits. In preferred embodiments of a first of its facets or aspects, the invention is apparatus for forming an arbitrary three-dimensional shape in a volume, by construction from colorant disposed in the volume.

The apparatus includes a two-dimensionally extended array of colorant-ejecting nozzles. The array is disposed substantially in one particular linear direction relative to the volume.

The apparatus further includes a programmed processor for controlling ejection of colorant from the nozzles to pass through the volume, forming the arbitrary three-dimensional shape therein. In addition the apparatus includes a two-dimensional colorant-retrieving frame—disposed substantially in a second linear direction opposite to the one particular direction, from the array.

Several understandings will be helpful for purposes of this document (and not only this facet of the invention). The term "colorant" encompasses a great variety of materials. As one extreme case, some of the colorant may be transparent, i.e. without color as such; "colorant" of this sort can be used to help form part of a three-dimensional image structure.

As will later be seen, some fluids (particularly, but not necessarily, transparent fluids) employed in certain forms of the invention may be conceptualized either as colorant or as an image-supporting matrix or substrate. This distinction is to a large extent only semantic.

Some or all of the colorant may also be slightly colored but partially transparent or translucent, or may be opaque, or partway between these conditions. It may, but need not, be fluid; thus grains or granules of solid material may be used. If fluid, it may be ejected either as streams or as individually controlled colorant quanta.

The foregoing may represent a description or definition of the first aspect or facet of the invention in its broadest or most general form. Even as couched in these broad terms, however, it can be seen that this facet of the invention importantly advances the art.

In particular, this aspect of the invention is first to provide a three-dimensional stage-like volume—with multiple, potentially independent colorant flows generally through the volume from one face to another. The invention thus establishes a unique dynamic colorant-sculpturing environment, which is amenable to introduction of extremely fine and versatile effects—far surpassing any prior three-dimensional shape phenomena available heretofore.

In particular, this environment enables the formation of virtually any shape—i.e., arbitrary shapes, as recited above—rather than merely abstract patterns such as generally characteristic of the prior art. Prior material-forming systems such as skywriting or water fountains are incapable of this degree of finesse. On the other hand inkjet and other printing systems heretofore are limited to two dimensions.

Although the first major aspect of the invention thus significantly advances the art, nevertheless to optimize enjoyment of its benefits preferably the invention is practiced in conjunction with certain additional features or characteristics. In particular, preferably the invention includes some means for defining the volume between the array and the frame.

For purposes of generality and breadth in discussing the invention, these means may be called simply the "defining means". In case the invention does include such defining means, the apparatus preferably further includes some means for providing relative motion of the colorant through the volume from the array to the frame.

Again for purposes of breadth and generality these means are advantageously called the "relative-motion providing means" or more simply the "providing means". A still further preference is that the providing means include orientation of the array and frame respectively above and below the volume—whereby gravity induces the relative motion.

In this case it is yet further preferable that the frame be a substantially passive sump for recovering the colorant. An alternative preference is that the frame include a pump for redirecting colorant to the array for reuse.

In the latter case it is also preferred that the array eject colorant of plural characteristics; and that the apparatus of the invention also include filters for separating the retrieved colorant by those characteristics. In this situation it is particularly advantageous that the characteristics include both colors and associated physical characteristics for facilitating the separating by the filters.

Reverting to the earlier-mentioned preference for relative-motion providing means, it is also preferable for some kinds of shows that the invention include stroboscopic lighting for illuminating the colorant at successive instants selected to display apparent motion of an element in the image.

In preferred embodiments of its second major independent facet or aspect, the invention is in several ways similar to the first aspect but does not necessarily have a colorant path that passes between a directly opposed nozzle array and retrieving frame. This second aspect, however, does include a fluid-flow feature that is not necessarily present in the first aspect.

Thus the second facet of the invention is an apparatus for forming an arbitrary three-dimensional image in a volume, by construction from colorant disposed in the volume. The apparatus includes a two-dimensionally extended array of colorant-ejecting nozzles, and a programmed processor for controlling ejection of colorant from the nozzles to form such three-dimensional image.

The apparatus also includes a two-dimensional colorant-retrieving frame disposed in complementary relation to the array. Also included are some means for providing relative motion of the colorant through the volume from the array to the frame.

For purposes of breadth and generality once again, these means will be called simply the "relative-motion providing means". In this apparatus of the second aspect of the invention, the relative-motion providing means include a flow of fluid that is ejected with the colorant from the array; this fluid flow suspends the colorant in the volume.

The foregoing may represent a description or definition of the second aspect or facet of the invention in its broadest or most general form. Even as couched in these broad terms, however, it can be seen that this facet of the invention importantly advances the art.

In particular, the invention is first to provide a truly mechanical 3D image that is controllable and stable. By "mechanical" is meant that such an image exists in physical substance (in the manner of some two-dimensional images heretofore), as distinguished from a merely optical image.

As to control, inclusion of the two-dimensional retrieving frame here enables the invention to control or even prevent accumulation of the image colorant. By virtue of such control, the invention is free to generate, and to erase or refresh, image features on a generally continuous basis if desired—thereby in turn enabling creation of moving (i.e. changing) three-dimensional images.

The fluid flow accompanying the colorant establishes a three-dimensional substrate or matrix in which the physical substance making up the mechanical image is defined and suspended. This is the feature which imparts stability to the mechanical 3D image.

Although the second major aspect of the invention thus significantly advances the art, nevertheless to optimize enjoyment of its benefits preferably the invention is practiced in conjunction with certain additional features or characteristics. In particular, preferably the relative-motion providing means further include a mounting that supports the array for motion in a direction opposite the flow of fluid.

Another preference is that the fluid flow and the array motion with respect to the volume be substantially equal in speed though opposite in direction. By virtue of this characteristic, the image appears substantially stationary in the volume i.e.,—that is to say, the overall image appears stationary, though as will be understood elements or details making up the image may be in motion and indeed may appear to move in or out of the image volume.

When a mounting is included as described just above, it is also preferable that the volume-defining means include a chamber; and that the mounting include some means for supporting the array for motion—for generality, as before, the "supporting means". In one preferred embodiment, the chamber is substantially cylindrical and the motion substantially about a center of the chamber.

In a cylindrical format the supporting means may include an axle, or instead a peripheral track, or combinations of these. One subpreference is that the frame be mounted back-to-back with the array, for motion therewith about the supporting means.

Two alternative preferences are that the frame be a substantially passive sump for recovering the colorant; or include a pump for redirecting the colorant to the array for reuse. In the latter case, preferably the array ejects colorant of plural characteristics, and the apparatus further include filters for separating the retrieved colorant by the characteristics. Here the characteristics preferably include the colors, and also associated physical characteristics for facilitating the separating by the filters.

In preferred embodiments of its third major independent facet or aspect, the invention is an apparatus for forming an arbitrary three-dimensional shape in a volume, by construction from colorant disposed in the volume. The apparatus includes a two-dimensionally extended array of colorant-ejecting nozzles.

It also includes an enclosed chamber closely defining the volume. Further included in the apparatus is a programmed processor for controlling ejection of colorant from the nozzles to form the arbitrary shape.

The foregoing may represent a description or definition of the third aspect or facet of the invention in its broadest or most general form. Even as couched in these broad terms, however, it can be seen that this facet of the invention importantly advances the art.

In particular, provision of a chamber that defines the volume in a closely enclosing manner is plainly distinct from skywriting equipment that forms colorant shapes in an unconstrained body of air in the sky. Introduction of an enclosed chamber also stabilizes the atmosphere within the chamber and thereby greatly enhances ability to control formation and maintenance of the images.

Although the third major aspect of the invention thus significantly advances the art, nevertheless to optimize enjoyment of its benefits preferably the invention is practiced in conjunction with certain additional features or characteristics. In particular, preferably this facet of the invention is practiced together with the other aspects or facets of the invention that are introduced in this document.

In preferred embodiments of its fourth major independent facet or aspect, unlike the facets discussed above, the invention is an apparatus for forming an arbitrary two-dimensional image. The apparatus does, however, do so by construction from colorant.

The apparatus includes a generally one-dimensional array of colorant-ejecting nozzles. It also includes means for mounting the array to sweep along a path while ejecting colorant.

Further included is a programmed processor for controlling ejection of colorant from the nozzles to form such arbitrary image. The apparatus also includes a colorant-retrieving frame disposed in complementary relation to the array.

The foregoing may represent a description or definition of the fourth aspect or facet of the invention in its broadest or most general form. Even as couched in these broad terms, however, it can be seen that this facet of the invention importantly advances the art.

In particular, as in the above-discussed three-dimensional aspects of the invention, this facet of the invention is able to form arbitrary shapes in the colorant and thus surpasses the capabilities of prior fluid-ejection devices for two-dimensional image presentation—generally limited to abstract patterns.

Although the fourth major aspect of the invention thus significantly advances the art, nevertheless to optimize enjoyment of its benefits preferably the invention is practiced in conjunction with certain additional features or characteristics. In particular, preferably the path along which the array sweeps is cylindrical. In such forms the frame may preferably be mounted generally back-to-back with, and move with, the array.

All of the foregoing operational principles and advantages of the present invention will be more fully appreciated upon consideration of the following detailed description, with reference to the appended drawings, of which:

BRIEF DESCRIPTION OF THE DRAWINGS

FIG. 11 is a perspective view of an arbitrary object (a wire-frame parallepiped) to be imaged by the viewer of FIGS. 9 and 10;

FIG. 12 is a like view of a first step in construction of the FIG. 11 object by colorant particles, with only the base of the parallelepiped formed;

FIG. 13 is a like view of a second step, with side edges starting to be formed;

FIG. 14 is a like view of a third step, with a larger portion of the side edges added;

FIG. 15 is a like view of a fourth step, with the entire side edges nearly completed;

FIG. 16 is a like view of a final step, with the side edges finished and the top of the parallelepiped formed, and with the entire structure stroboscopically illuminated for viewing.

DETAILED DESCRIPTION OF THE PREFERRED EMBODIMENTS

1. Volume Printer—Solid Body Dynamic Display

Figure 1:
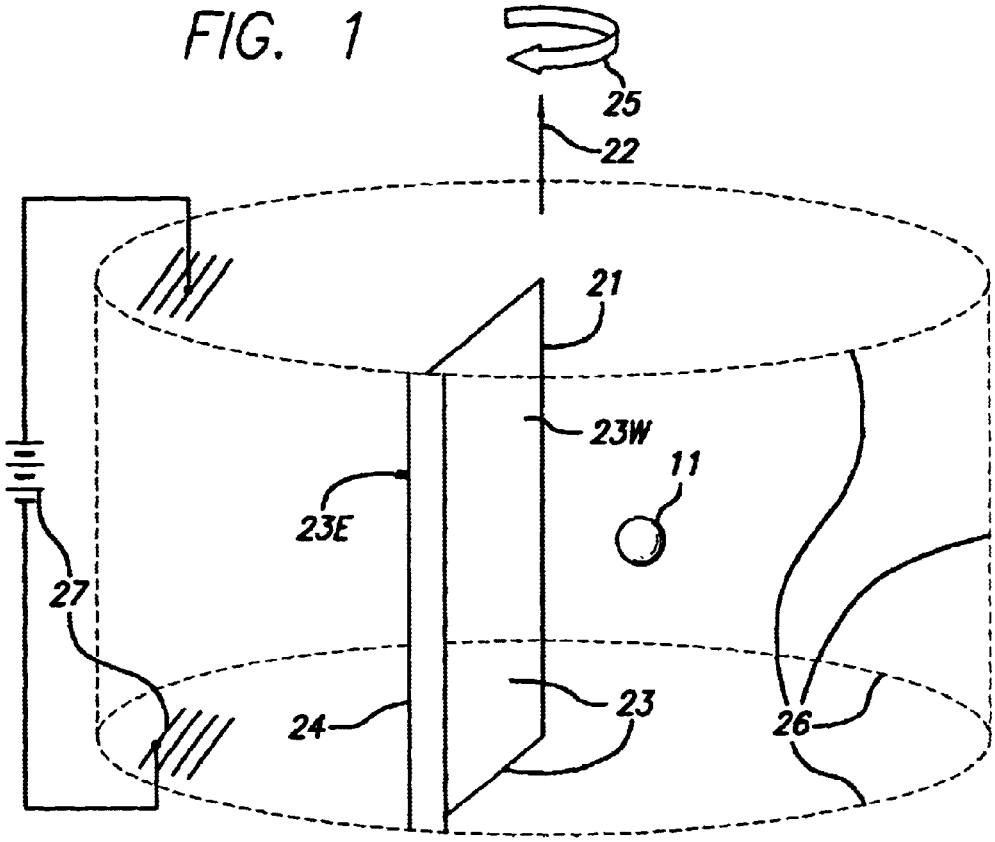
FIG. 1 is a perspective or isometric view, quite schematic, of a rotary writing/erasing frame with a colorant particle suspended by the frame, in a volume printer according to certain aspects of the invention.

This device has the ability to display, or in a sense recreate, a three-dimensional body or scene—on the air or other fluid, or even in a void. As described in the "BACKGROUND" section of this document, earlier techniques either fall short of physically recreating the object/scene in three-dimensional space, or are very primitive in their capability to finely control details or animation of the object.

Preferred embodiments of the present invention operate in a way that is very generally analogous to traditional animation. Here, however, the image is not flat or merely a projection; instead the shapes which appear are three-dimensional and formed of actual, physical substance. This can be appreciated by a series of incremental examples.

- A single point can be defined or laid in the air (or other fluid, or even without such fluid), as for instance by putting something 11 (FIGS. 1 and 2)—a solid particle, or a drop of fluid—at one point of a 3D space.
- This point can be erased from its position and another point defined at the same position or in a position close to the first.
- This sequence can be repeated as many times as desired, and in principle very quickly.
- The result is that a visible point appears to move; and in fact there is either actual motion of the physical particle or droplet, or successive different positions of multiple physically distinct particles or drops.
- Any 3D body, or for instance its exterior surface, in principle can be recreated by multiple tiny particles or streams—analogously to the printing of a 2D image using discrete particles (for instance by conventional printing techniques, e.g. inkjet or laser printing).
- By animation (as discussed just above) of all the points that recreate the 3D body or its surface, the effect is of a 3D body moving in the 3D space. Physically such phenomena can be created in a variety of different ways, a first simple one of which will now be described. To put a particle 11 in the air, and animate it, a frame 23 is mounted to rotate 25 from one of its edges 21, about a system axis 22.

As it rotates it describes or, so to speak, "wipes" a cylindrical volume 26 in the air or other medium—or even in a vacuum. One face 23E of the frame is able to erase, i.e. remove, whatever is in its way as it rotates.

The other face 23W of the frame is able to locate and define—or in other words write—the spatial point at which the above-mentioned physical point is to be laid in the space. The result is that, in each complete rotation the frame erases the existing point and replaces it with another one.

(The frame writes at its retreating face 23W, and erases at its advancing face 23E. In the illustration, the frame 23 is understood to be rotating clockwise 25 as seen from above. Hence, when the frame 23 is near the front of the space—i.e. appearing to be near the reader of the illustration—the writing face 23W is at the right and the erasing face 23E at the left as shown.) Depending on the new position, an observer can see the point 11 suspended in the space—either seemingly motionless or moving within the wiped volume 26. It will be understood that the physical point has mass and so is subject to the gravitational attraction; this concern will be taken up shortly.

The capability of the rotating frame is straightforwardly extended so that—instead of only one single point—the frame is able to remove and place multiple points as it rotates. Now the result is animation of a 3D object or scene.

The technology of the frame advantageously works as follows, for laying particles or droplets in a fluid. Assume a flow 32 (FIG. 2) of air or other fluid.

Figure 3:
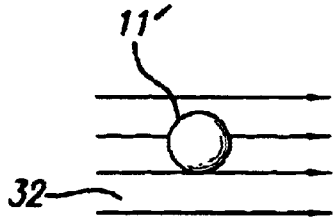
FIG. 3 is a like diagram of the FIG. 2 particle entrained in the flow.

Laminar flow is preferred for simplicity, although turbulent flow can also be used—as for instance to obtain special effects, but with some tradeoffs. A particle or droplet 11 can be dropped 31 into this fluid flow 32, and the particle (if sufficiently lightweight relative to the flow) as it appears 11' in FIG. 3 is trapped in the flow 32 and acquires the same velocity as the flow.

Next this physical phenomenon is imported into the context of the rotating frame. From one face 23W (FIG. 4) of the frame (the face that drops the particles into the volume) a droplet 11' is expelled—in the opposite direction of the movement 25' of the frame. A fluid flow 32, also originating 33 from within the writing face 23W, is established as well.

In particular the velocity of the emerging drop relative to the frame is equal but opposite to the velocity 25' of the frame at this point (naturally this velocity is proportional to the radius, i.e. the distance from the rotation axis, for the nozzle which is at the ejection point). Therefore the absolute velocity of the particle laid in the fluid is zero; that is, the particle is stationary, suspended in the fluid flow 32.

On the other hand, at the opposite face 23E of the frame the fluid 32' (plus whatever 11" is floating in it) is ingested by suction 33' at the same flow rate. Exactly the same volume of fluid is delivered at the writing/printing face 23W of the frame as is being retrieved at the erasing/removing side 23E. This equality not only facilitates stabilization of the fluid flow in a laminar condition, but also maintains the resultant absolute velocity of the fluid flow 32 and particle 11' at zero.

Now the overall operation encompasses a frame that can locate points at any coordinates within its edges. The result, again, is a complete 3D scene including arbitrary elements such as creatures 13 (FIG. 5), edifices 14 and so on, all supported on the fluid flow 12—and, if desired, animated—within the boundaries of the wiped cylinder.

Particular care in design is advantageously devoted to generating laminar flow as a function of radius, at both the ejecting and retrieving faces of the frame. In imperfectly laminar (or distinctly turbulent) flows, a particle tends to move from its desired position.

The more frequent the refreshment of the image, the smaller the positional variation that is attainable. Thus if desired the frame 23 may move quite rapidly (as for instance multiple rotations per second); or the single writing/erasing frame may be replaced by plural such frames in series; or both. The greater the number of frames, however, the more difficult it is to camouflage them or otherwise to avoid their interfering with the illusion of the scene, within an observer's perception, as an existing reality.

The array 23*aa*–23*ge* (FIG. 5) of nozzles associated with the frame may be regarded as a kind of mesh structure. Although the system is illustrated as having only a five-by-seven nozzle array, this is merely for simplicity of illustration and the invention is amenable to very high writing resolution.

Inkjet technology offers one idea of the levels of resolution (currently as fine as 25 dots/mm, 600 per inch, and even finer) that are possible—and also one idea of the way in which colorant quanta can be expelled systematically, smoothly and quietly into the supporting fluid stream. The invention, however, is amenable to practice at a great range of different scales, particularly including spaces 26 that are considerably larger than the people who may view the scenes. For display mechanisms at such scale, much coarser image formation (for instance even one dot per centimeter, or per decimeter) may be preferable.

The mesh resolution depends in part upon the carrying fluid if any: if that fluid is compressible (e.g. air or other gas)—and particularly if the particle or droplet too is compressible—the mesh can be finer. The particle then expands as it leaves its particular nozzle in the mesh.

If monochrome colorant quanta (droplets or particles) are used, they are recirculated easily. In case of different colors, the quanta may be either discarded after use (leading to high colorant consumption) or recaptured through physical filters coordinated with physical characteristics (mass, electrical charge, chemical makeup etc.) initially impressed on the material of different colors.

For the purpose of simplicity in this document and particularly the appended claims, all of the droplets, particles and suspending fluid used in the invention may be denominated "colorant"—whether they are in fact monochrome, or chromatically colored, or even colorless (e.g. transparent). "Colorant" that is colorless is important in that it enables formation of chromatically or gray-scale colored shapes that include supported voids, apertures and other concavities.

Gravity tends to disrupt performance, particularly if the density of the particle or droplet material is significantly different from that of the suspending fluid (if any). That is to say, the colorant tends to fall or rise in a suspending fluid; however, as with turbulence, the higher the frequency of refreshment of the image—and the better matched the densities—the smaller the variation of position due to gravity.

The illustrated system need not have a vertical axis of rotation. With a horizontal axis, gravity artifacts can be reduced or at least obscured.

Perhaps an ultimate form of density mismatch occurs if such particles or droplets are to be laid in a vacuum. In this case, particularly if the scale of the device is rather small (e.g. on the order of thirty centimeters or less), the particles can be suspended by a force field.

Such a field may be for instance an electrical field as in the famous Millikan oil-drop experiment, or alternatively a magnetic field if the particles can be made of material that responds adequately to such a field. (In industrial contexts, small alignment forces or corrective forces are achievable with strong magnetic fields even for some materials that are not ferromagnetic.)

Means 27 (FIG. 1) for establishing such force fields can also be used in systems that do have some suspending fluid. The fields can be employed either to enhance suspension, if the fluid is tenuous in comparison with the particle weight, or to provide special effects as for example abrupt transverse motion (not necessarily vertical) of particles before encountering the erasing face of the frame. Although the illustration suggests a single unitary field for the entire space 26, geometrically much finer control is readily provided.

A particularly simple implementation, and hence one preferred embodiment of the invention, utilizes one single column 44 (FIG. 6) of nozzles—or equivalently e.g. closely adjacent staggered columns as seen in inkjet printing. In this case for instance the images 15, 16 may be displayed only in a form that may be regarded as two-dimensional, wrapped around the cylindrical locus 46 of the nozzle column. More precisely, however, this "2D" form may be regarded as still a volume printer, though the volume is perhaps only a relatively thin annulus.

A related equivalent may be a scanning zero-dimensional head, i.e. a single nozzle that is moved up and down to serve the same purpose as a column or a two-dimensional array of nozzles. For either the scanning single nozzle or the 2D column of nozzles, any of a great variety of mechanisms can be used to impart the cylindrical motion. Merely by way of example, the top and bottom of the scan path or column 44 may be fixed by radial arms 47' (FIG. 7) to an actual axle 42; or may be coupled by a pair of rollers 47" to ride along circular tracks 46".

The systems described above emphasize relatively simple geometries created by nozzle columns (or two-dimensional arrays of nozzles) that simply rotate about a system axis, within a generally cylindrical chamber. This chamber may be quite small—as for instance to operate within an ordinary room for viewing as in the manner of observing a television set—or may instead be very large, for viewing as in the manner of observing a large-screen motion picture or monumental-scale display. Of course intermediate sizes too are feasible.

Furthermore, multiple writing/refreshing frames can be provided within a single apparatus, to yield more frequent refreshment and writing for the various purposes mentioned earlier. All these various forms of the invention are capable of providing a direct view, with the naked eye, and a very wide angle of vision—essentially even a complete 360-degree view.

2. Three-dimensional Cascade/Shower Viewer

As in the volume printers discussed in the preceding section, this device has the ability to recreate three-dimensional objects or scenes in a three-dimensional space. The cascade viewer, or shower viewer, operates by dropping discrete particles or flows through the three-dimensional space.

Preferred embodiments of this form of the invention may be regarded as a defined "rain" of particles, such as droplets, that is illuminated at intervals (e.g. periodically) by means of a flash or stroboscopic light to provide a succession of views. Visual integration of the successive views yields the sensation of animation.

As before, incremental examples help to describe how the invention works.

For single particle animation, first an individual particle moves downward in darkness.

As it crosses the viewable area (frame), it is illuminated by a flash and can be seen in its instantaneous position.

A second, with the same physical appearance, follows the first.

It too is illuminated within the viewable area, either at the same position where the first particle was illuminated or at a different position. If the flashing frequency is high enough (particularly high enough to exploit the well-known persistence characteristic of human vision), the particle seems to be animated within the frame.

In the same way that a picture can be printed by discrete drops, a three-dimensional body can be displayed in the viewable frame by discrete particles that simulate the geometry of the body—dropped from a two-dimensional array of particle-ejecting nozzles or the like. Thus for example to display a wire-frame parallelepiped, the whole geometry can be formed in the frame volume before flashing the light:

First the array prints (i.e. forms in space) the bottom frame of the parallelepiped.

Then, after that frame has fallen a desired distance (the desired spacing between particles vertically in the image), the array prints one drop in each of the vertical edges of the parallelepiped.

After allowing like intervals for falling of those first two elements of the parallelepiped, the array prints additional drops to accumulate as the lower-central portion of the figure.

With further similar intervals and particle ejections, the upper-central portion of the shape is drawn.

Finally the array prints the top frame of the parallelepiped.

Next the light is flashed to illuminate the entire object in position.

Then for the next frame of the animation, the whole geometry is redrawn again in a new position. Once it is ready to be illuminated, the flash is triggered again—and so on for the rest of the scenes in the animation.

Smooth animation requires flashing at very short intervals or periods. This in turn requires that the scenes for each frame be drawn very quickly—in the time between flashes.

The falling particles can simply be drawn down by gravity; however, this imposes undesired limitations on the resulting presentation. If gravity is the only control, then given a height of the image to be displayed, the flashing intervals are linked to that height and it is not possible to flash very often. Alternatively, given desired flashing intervals the height of the image is constrained.

Another desired characteristic of the system is that the particles follow a straight, vertical (or otherwise controlled) trajectory. Depending on the size of the particles and the figure to be displayed, the fluid (e.g. air) next to the particles can move, so that the position of the particle is not guaranteed.

These seeming obstacles are resolved by using generally the same sort of array as in the volume printer, i.e. an array that is able to eject air or other fluid at the same time that it drops particles in this flow. This technique tends to raise the speed of the overall flow.

The higher the flow speed, the higher the flashing frequency or taller the image to be displayed. Also, since all the fluid in the volume is moving at the same rate, the flow can be much more controlled.

Although the example discussed here relates to formation of a regular rectangular parallepiped, both the object created in the volume and the volume itself may be of nearly arbitrary cross-sections in all directions. The word "nearly" is used here because the volume is somewhat constrained by evident geometrical requirements on placement of the nozzles and the retrieving frame.

3. Operating System

Practice of this invention, like that of inkjet and laserjet printing on paper, requires only a minimum of hardware. That minimum, however, typically must be very advanced and specialized—and provided with properly prepared image data and very careful control programming.

Figure 17:
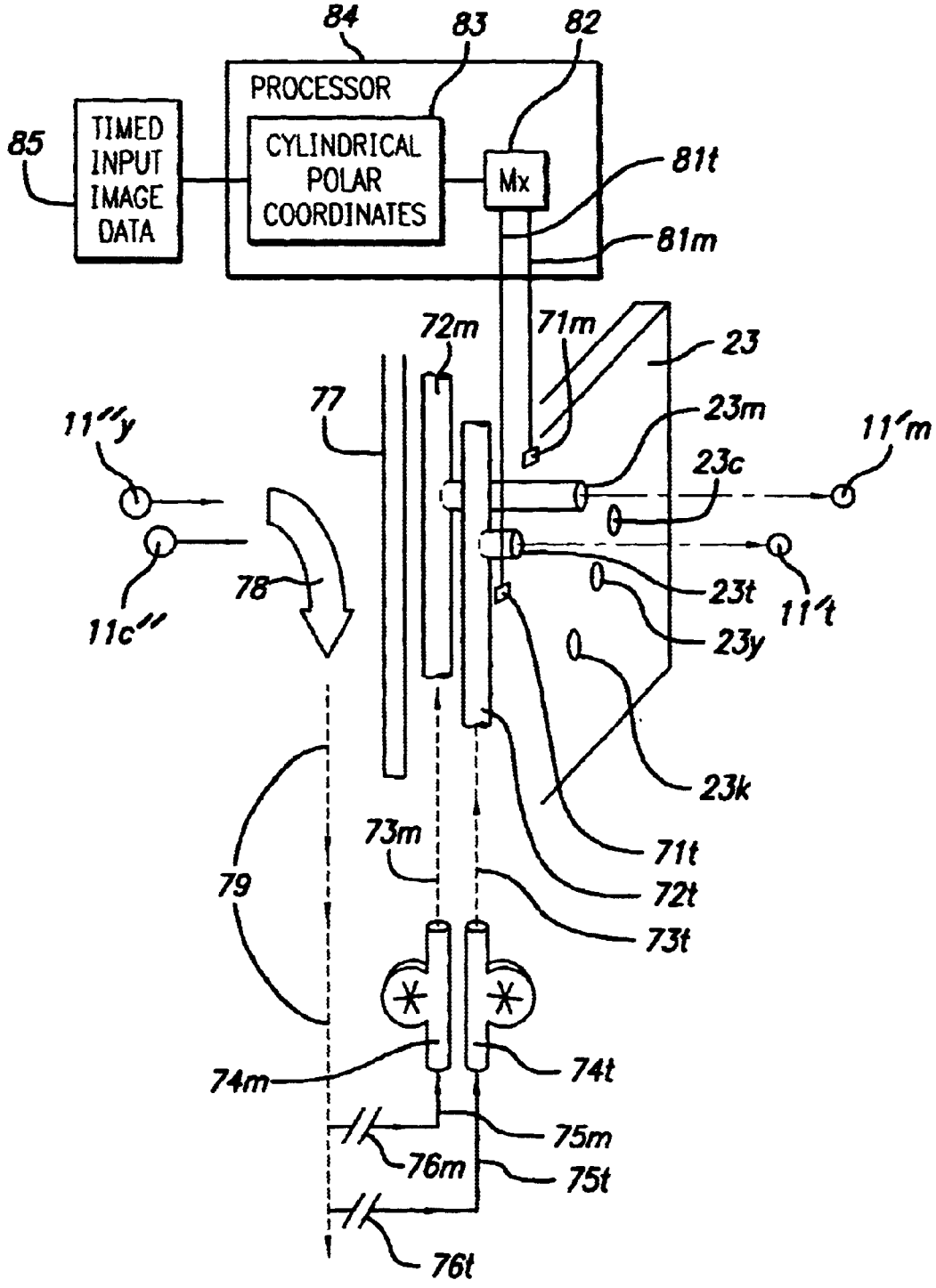
FIG. 17 is a representation, somewhat schematic, of a hardware system according to the invention.

In one embodiment particularly related to the volume writer discussed earlier, magenta quanta 11'*m* (FIG. 17) and transparent quanta 11'*t*, and quanta of other colorants such as cyan, yellow and black as well, are ejected from nozzles 23*m*, 23*t*, 23*c*, 23*y*, 23*k* formed in clusters in a common nozzle plate 23W—i.e. in the writing face of the two-sided frame discussed earlier. For simplicity's sake, only one such cluster is shown.

Behind the nozzle plate 23W are a representative magenta-nozzle heater resistor 71*m*, transparent-nozzle heater resistor 71*t*, and similar heater resistors—omitted from the drawing, for clarity—to serve the other nozzles. Each of these resistors is used to create and vaporize a small bubble, behind a small quantity of colorant that is in a vaporization chamber associated with or forming part of the corresponding nozzle, thereby expelling the colorant quantity as a colorant quantum or droplet.

These heaters in turn are interconnected by a network of control wires 81*m*, 81*t* for the magenta and transparent nozzles with a multiplex unit 82 in a processor 84. Other control wires—for the other nozzles—are also omitted from the illustration for the sake of clarity.

Figure 2:
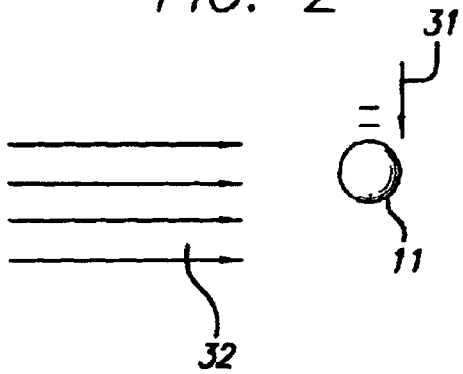
FIG. 2 is a diagram of a colorant particle being dropped into a fluid flow, for reference in discussion of primary principles used in the FIG. 1 printer.
Figure 5:
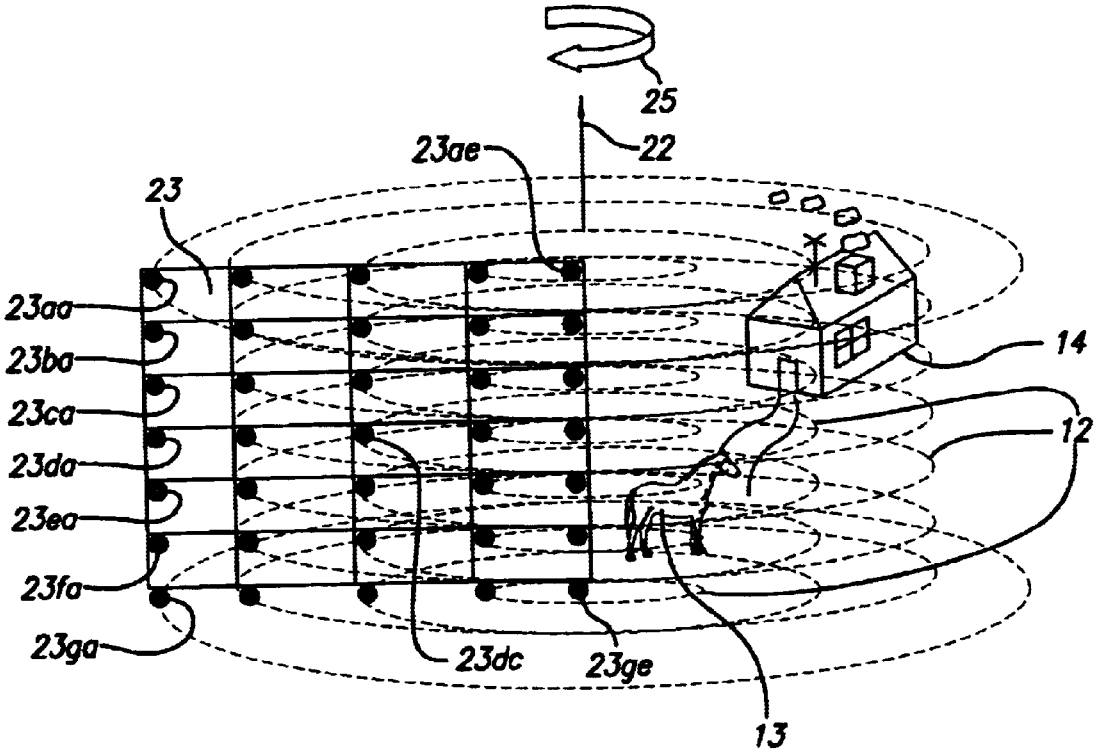
FIG. 5 is a view like FIG. 1 but emphasizing the meshlike nozzle array of the frame, and also including representative arbitrary images suspended in adjacent fluid flow.
Figure 6:
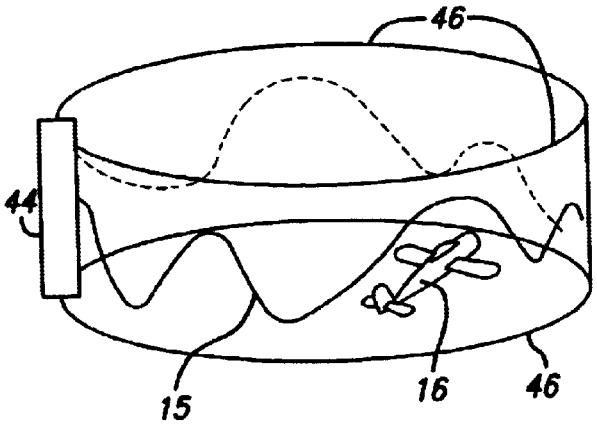
FIG. 6 is a view like FIG. 1 but of a 3D device with a 1D nozzle array for printing in only a 2D cylindrical annular format—and also including representative arbitrary imaging.

Also in or associated with the processor 84 is a computational stage 83 for reformatting input data 85 as necessary for the polar or cylindrical geometry of FIG. 1, 5 or 6. The processor itself may be a digital or analog electrical type, or optical type; merely by way of example it may take the form of a general-purpose processor such as that in a general-purpose computer, with specific programming for the volume printer device in an application program stored e.g. in the computer hard drive.

Alternatively the processor may take the form of a dedicated general-purpose processor that is part of the volume printer device, and that reads programming from a read-only memory (ROM) also in that device. The processor instead may take the form of a raster image processor (RIP); or may take the form of an application-specific integrated circuit (ASIC)—or may be combinations of any two or more of these possibilities, all as well known in the inkjet and laserjet printing arts.

Behind the heaters 71*m*, 71*t* and other heaters, the nozzles and vaporization chambers are interconnected by separate networks of tubing 72*m* carrying magenta colorant 73*m* to the magenta-colorant nozzle 23*m*, and tubing 72*t* carrying transparent colorant 73*t* to the transparent-colorant nozzle 23*t*, and so on for the other colors. Each tubing network 72*m*, 72*t* etc. draws its respective colorant supply from a respective pump 74*m*, 74*t*, fed in turn by a respective supply 75*m*, 75*t* whose sources will be discussed shortly. If preferred the supplies 75*m*, 75*t* etc. can instead be elevated, and these elevated supplies replenished by the pumps.

At the other side of a bulkhead 77 within the frame 23 (FIGS. 1 and 4) is the suction system 78 noted earlier. It recovers yellow colorant quanta 11"*y*, cyan quanta 11"*c*, etc., returning all the colorant at 79 to a series of filters 76*m*, 76*t* etc. for separating the recaptured colorants and routing them to their previously mentioned respective individual supplies 75*m*, 75*t* etc.

The filters may operate by any of a very great variety of characteristics of the colorants. Such filtering characteristics may include but are not limited to electronegativity, viscosity, density, and even color itself (particularly if the colorants of different colors are mutually immiscible).

Figure 4:
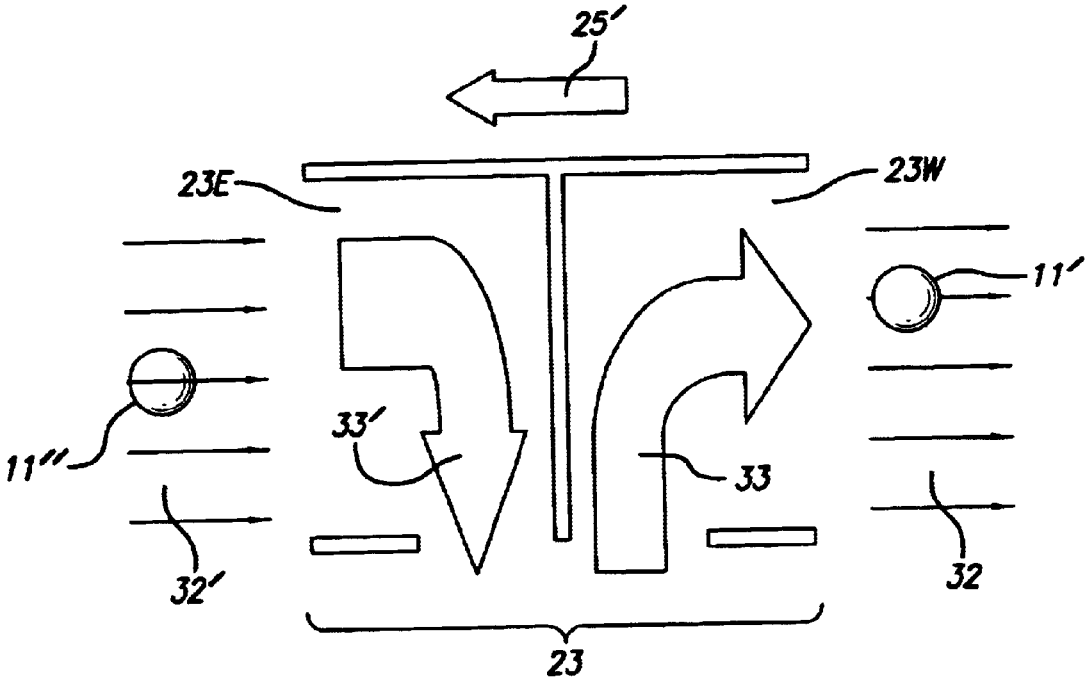
FIG. 4 is a cross-sectional elevation, very greatly enlarged and also quite schematic, of the FIG. 1 frame with colorant particles in adjacent fluid flow.
Figure 7:
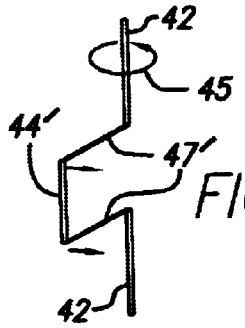
FIG. 7 is a sketch showing one arrangement for driving the FIG. 6 nozzle in a cylindrical path.
Figure 8:
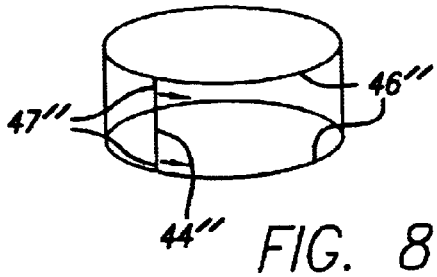
FIG. 8 is a like sketch but showing a different arrangement.
Figure 9:
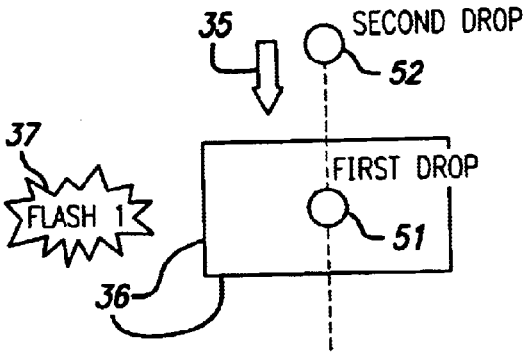
FIG. 9 is an elevation, highly schematic, of a viewing frame and colorant particles being dropped through the frame, in a cascade viewer or shower viewer according to certain other aspects of the invention.
Figure 10:
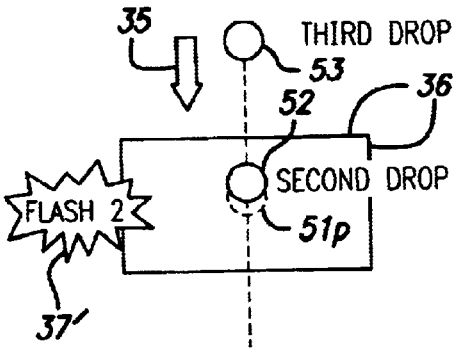
FIG. 10 is an elevation like FIG. 9, but showing different colorant particles at a slightly advanced stage of operation.

Although this discussion is couched in terms of a system most closely related to the 3D volume writer of FIGS. 1, 4 and 5, it is generally applicable as well to the 2D volume writer of FIGS. 6 through 8 and the cascade or shower viewer of FIGS. 9 through 16. Appropriate adaptation will be particularly clear to those readers skilled in the field of inkjet printing.

The above disclosure is intended as merely exemplary, and not to limit the scope of the invention—which is to be determined by reference to the appended claims.

What is claimed is:

1. Apparatus for forming an arbitrary three-dimensional shape in a volume, by construction from colorant suspended in the volume; said apparatus comprising:

disposed substantially in one particular direction relative to the volume, a two-dimensionally extended array of colorant-ejecting nozzles;

a programmed processor for controlling ejection of multiple droplets of colorant from the nozzles for suspension in the volume, forming such suspended arbitrary three-dimensional shape therein; and a two-dimensional colorant-retrieving frame disposed substantially in a second direction opposite to the one particular direction, from the array, for recovering such suspended multiple droplets.

2. The apparatus of claim 1, further comprising:

means defining such volume between the array and the frame.

3. The apparatus of claim 2, further comprising:

means for providing relative motion of the colorant through the volume from the array to the frame.

4. The apparatus of claim 3, wherein:

the relative-motion providing means comprise orientation of the array and frame respectively above and below the volume;

whereby gravity induces said motion.

5. The apparatus of claim 4, wherein:

the frame is a substantially passive sump for recovering the colorant.

6. The apparatus of claim 4, wherein:

the frame comprises a pump for redirecting the colorant to the array for reuse.

7. The apparatus of claim 3, further comprising:

stroboscopic lighting for illuminating the colorant at successive instants selected to display apparent motion of an element in the image.

8. Apparatus for forming an arbitrary three-dimensional shape in a volume, by construction from colorant disposed in the volume; said apparatus comprising:

disposed substantially in one particular linear direction relative to the volume, a two-dimensionally extended array of colorant-ejecting nozzles;

a programmed processor for controlling ejection of colorant from the nozzles to pass through the volume, forming such arbitrary three-dimensional shape therein; and a two-dimensional colorant-retrieving frame disposed substantially in a second linear direction opposite to the one particular direction, from the array;

means defining such volume between the array and the is frame; and means for providing relative motion of the colorant through the volume from the array to the frame; and wherein:

the relative-motion providing means comprise orientation of the array and frame respectively above and below the volume;

whereby gravity induces said motion;

the frame is a substantially passive sump for recovering the colorant;

the frame comprises a pump for redirecting the colorant to the array for reuse;

the array ejects colorant of plural characteristics; and further comprising filters for separating the retrieved colorant by said characteristics.

9. The apparatus of claim 8, wherein the characteristics comprise both:

colors; and associated physical characteristics for facilitating said separating by the filters.

10. Apparatus for forming an arbitrary three-dimensional image in a volume, by construction from multiple drops of colorant disposed in the volume; said apparatus comprising:

a two-dimensionally extended array of colorant-ejecting nozzles;

a programmed processor for controlling ejection of multiple droplets of colorant from the nozzles to form such three-dimensional image;

a two-dimensional colorant-retrieving frame disposed in complementary relation to the array for recovering such suspended multiple droplets; and means for providing relative motion of the suspended colorant from the array to the frame through the volume;

wherein the relative-motion providing means comprise a flow of fluid ejected with the colorant from the array and suspending the colorant in the volume.

11. The apparatus of claim 10, wherein:

the relative-motion providing means further comprise a mounting that supports the array for motion in a direction which, at least at an instant of said ejection, is opposite said flow of fluid, to thereby suspend the colorant in the volume.

12. The apparatus of claim 11, wherein:

the fluid flow with respect to the array and the array motion with respect to the volume are substantially equal in magnitude of velocity but opposite in direction;

whereby such image appears substantially stationary in the volume.

13. The apparatus of claim 12, wherein:

the volume-defining means comprise a substantially cylindrical chamber; and the mounting comprises means for supporting the array for rotational motion, substantially about a center of the chamber.

14. The apparatus of claim 12, wherein:

the frame is mounted back-to-back with the array, for rotational motion therewith.

15. The apparatus of claim 14, wherein:

the volume-defining means comprise a substantially cylindrical chamber; and the mounting comprises means for supporting the array for rotational motion, substantially about a center of the chamber.

16. The apparatus of claim 11, further comprising:

means for moving the array in a substantially cylindrical path; and means for moving the frame in a complementary disposition with the array.

17. The apparatus of claim 11, wherein:

the frame is a substantially passive sump for recovering the colorant.

18. The apparatus of claim 17, wherein:

the frame comprises a pump for redirecting the colorant to the array for reuse.

19. The apparatus of claim 18:

wherein the array ejects colorant of plural characteristics; and further comprising filters for separating the retrieved colorant by said characteristics.

20. The apparatus of claim 19, wherein the characteristics comprise both:

colors; and associated physical characteristics for facilitating said separating by the filters.

21. Apparatus for forming an arbitrary three-dimensional shape suspended in a volume, by construction from colorant disposed in the volume; said apparatus comprising:

a two-dimensionally extended array of colorant-ejecting nozzles;

means for closely defining such volume and for suspending said colorant therein, said defining-and-suspending means comprising an enclosed chamber that closely defines such volume; and means for controlling ejection of colorant from the nozzles to form such arbitrary suspended shape, said controlling means comprising a programmed processor.

22. The apparatus of claim 21, further comprising:

electrostatic or electromagnetic means for controlling the colorant position in the chamber after ejection.

23. Apparatus for forming an arbitrary two-dimensional image suspended transitorily by construction from multiple droplets of colorant; said apparatus comprising:

a generally one-dimensional array of colorant-ejecting nozzles;

means for mounting the array to form such suspended a image by sweeping along a path while ejecting said multiple droplets of colorant;

means for controlling ejection of colorant from the nozzles to form such arbitrary image, said controlling means comprising a programmed processor for controlling said ejection; and means for collecting the colorant that forms such arbitrary image, said collecting means comprising a colorant-retrieving frame, disposed in complementary relation to the array.

24. The apparatus of claim 23, wherein:

the frame is mounted generally back-to-back with and moves with the array.

* * * * *